United States Patent [19]

Katzman

[11] 4,008,547

[45] Feb. 22, 1977

[54] IN-GROUND SWIMMING POOL

[76] Inventor: Frederick Katzman, 5 Stonewyck Drive, Belle Meade, N.J. 08502

[22] Filed: Aug. 11, 1975

[21] Appl. No.: 603,334

[52] U.S. Cl. ..... 52/169.7; 4/172.19; 52/146; 52/251

[51] Int. Cl.[2] ..... E04H 3/16

[58] Field of Search ..... 4/1, 172, 172.19; 52/169, 464, 262, 732, 146, 251, 720, 270, 102, 272, 468, 282

[56] References Cited

UNITED STATES PATENTS

| | | | |
|---|---|---|---|
| 760,974 | 5/1904 | Dyarman et al. | 52/282 |
| 1,605,597 | 11/1926 | Long | 52/282 X |
| 1,946,733 | 2/1934 | Davis | 52/282 |
| 1,966,964 | 7/1934 | Kennedy | 52/272 X |
| 2,136,415 | 11/1938 | Cornett | 52/295 X |
| 3,381,430 | 5/1968 | Wiczer | 52/282 |
| 3,416,165 | 12/1968 | Pereira | 4/172.19 |
| 3,458,875 | 8/1969 | Michalke et al. | 4/172.19 |
| 3,466,676 | 9/1969 | Barrera | 4/172.19 |
| 3,485,405 | 12/1969 | Dement | 52/282 |
| 3,543,463 | 12/1970 | Cannon | 52/282 |
| 3,574,870 | 4/1971 | Orelind | 4/172.19 |
| 3,584,319 | 6/1971 | Van Den Brock | 4/172.19 |
| 3,641,595 | 2/1972 | Viessmann | 4/172.19 |
| 3,688,460 | 9/1972 | Van Loghem et al. | 52/468 X |
| 3,736,599 | 6/1973 | Kessler et al. | 52/282 |
| 3,877,188 | 4/1975 | Struben | 52/169 |
| 3,938,199 | 2/1976 | Laren | 4/172.19 |

FOREIGN PATENTS OR APPLICATIONS

| | | | |
|---|---|---|---|
| 366,144 | 1/1963 | Switzerland | 52/262 |

*Primary Examiner*—Leslie Braun
*Attorney, Agent, or Firm*—Norman N. Popper

[57] ABSTRACT

An in-ground swimming pool having a plurality of panels; the vertical edges of each adjacent panel seized between a front wall-joint and rear back-up joint having a rearwardly extending U-shaped channel to receive one side edge of a triangular brace; another U-shaped channel to receive the other side edge of the triangular brace; another U-shaped channel at the top of each panel to receive the edge of a deck member; a double channel having a regular position attached at the top of the panels to receive the outer edge of a horizontal deck; another double channel having a regular channel, receiving the bottom of each panel, and offset channels on each double channel receiving an outer edge of the deck; each offset channel having a brace attached at each end in the offset channels.

1 Claim, 12 Drawing Figures

IN-GROUND SWIMMING POOL

BACKGROUND OF THE INVENTION

1. Field of the Invention

This invention relates generally to swimming pool constructions, and specifically to an in-ground swimming pool construction involving a totally integrated system for setting up an in-ground liner-type swimming pool.

2. Prior Art

Numerous pool constructions have been devised for setting up above ground swimming pools, as for example the present inventor's U.S. Pat. No. 3,298,038. There are also numerous other swimming pool constructions providing various construction members for setting up a swimming pool, as for example O'Connell, U.S. Pat. No. 3,142,069. The present invention presents a totally integrated system, including joints and various complementary joints to join together panels of a side wall and a corner, and to provide reinforcing braces for the side wall panels, and braces for a deck, so that the swimming pools of numerous and varied dimensions can be set up using the same components for various shapes and sizes of in-ground swimming pool wall constructions.

SUMMARY OF THE INVENTION

It has been found that panels may be disposed on a foundation and seized together at their vertical edges by front and back back-up joints of special design, and front and back-corner joints and back-up corner joints, so as to set up a continuous, rigidly-supported wall structure. In addition, the wall structure may be anchored firmly and upwardly and outwardly extended braces for sustaining a deck. Further, generally triangular braces may be attached to each of the wall joints and back-up joints, so as to bolster the panels against deformation by the force of the water contained in the pool.

THE DRAWINGS

These objects and advantages as well as other objects and advantages may be attained by the devices shown by way of illustration in the drawings in which.

PREFERRED EMBODIMENT

Figure 1:
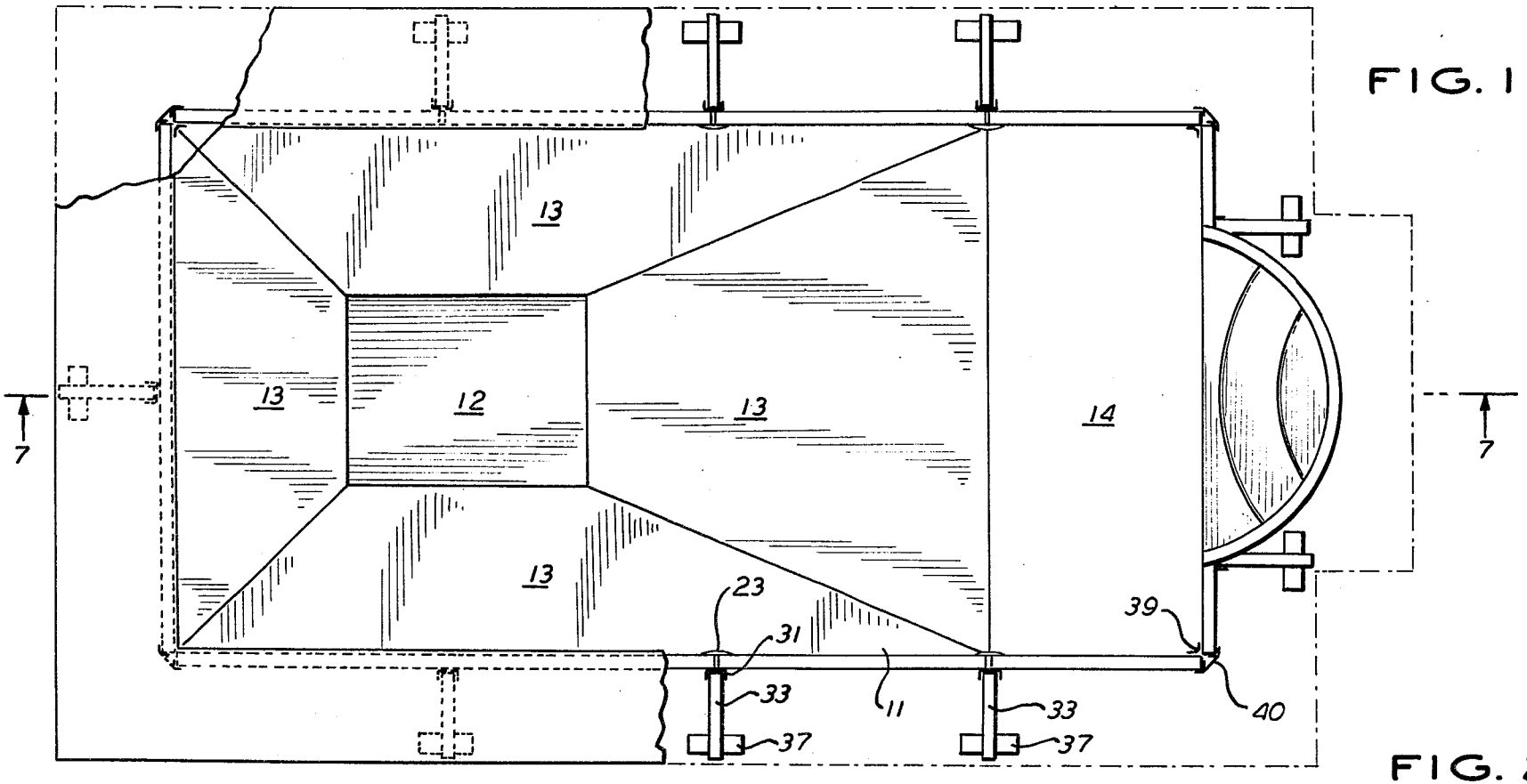
FIG. 1 is a top plan view of an in-ground swimming pool incorporating the present invention.

Referring now to the drawings in detail, the in-ground swimming pool construction as shown generally in FIG. 1, is formed around an excavation covered with poured concrete defining a hopper 11 having a flat, rectangular center pan 12, from which radiates four truncated triangular sloping sides 13, forming the hopper 11, constituting the deeper end of the pool. At one end of the hopper 11, there is generally flat shallow floor 14. The center pan 12, the truncated sides 13, the shallow floor 14 are made of poured concrete, finished with coats of rubber paint.

Figure 2:
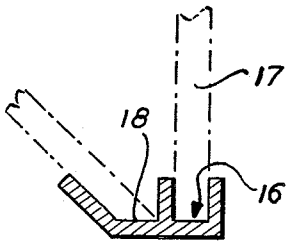
FIG. 2 is a cross-sectional view of a double channel for holding the bottom of the swimming pool wall panel, and for holding both ends of a brace, and also for holding a deck.
Figure 10:
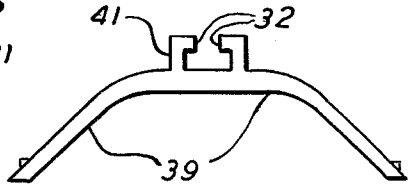
FIG. 10 is an end-view of an inside joint for a pool corner.
Figure 8:
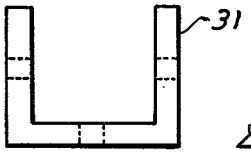
FIG. 8 is an end-view of a channel.
Figure 5:
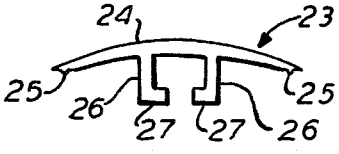
FIG. 5 is cross-sectional view of a convex wall joint.
Figure 3:
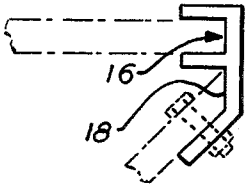
FIG. 3 is an end-view of the same double channel reoriented to receive a brace and a deck member.

On top margin of the concrete, in a shallow trough 15, surrounding the poured concrete, a generally U-shaped double channels 16 (see FIG. 2) is layed to receive vertically disposed panels 17, which define the vertical walls of the pool. Each panel 17 has its bottom edge seated in the regular U-shaped channel of the double channels 16. Each double channel 16 has an integrally formed oblique channel 18 to receive a diagonal brace 19 which is bolted thereto. The other end of the brace 19 is bolted to an identical oblique channel 18 in an upper double channel 16, and is secured thereto by a bolt. The integral U-shaped channel 16 receives the outer edge of a deck member 9. The other end of the deck member 9 fits into a horizontal U-channel 20 attached to the panel 17. A coping 21 is attached to the deck 9 with the copings bull-nose overlying the panel 17. A channel 22 in the coping 21 will hold the edge of a pool liner 10.

Figures 4, 6, 7, 9, 11, 12:
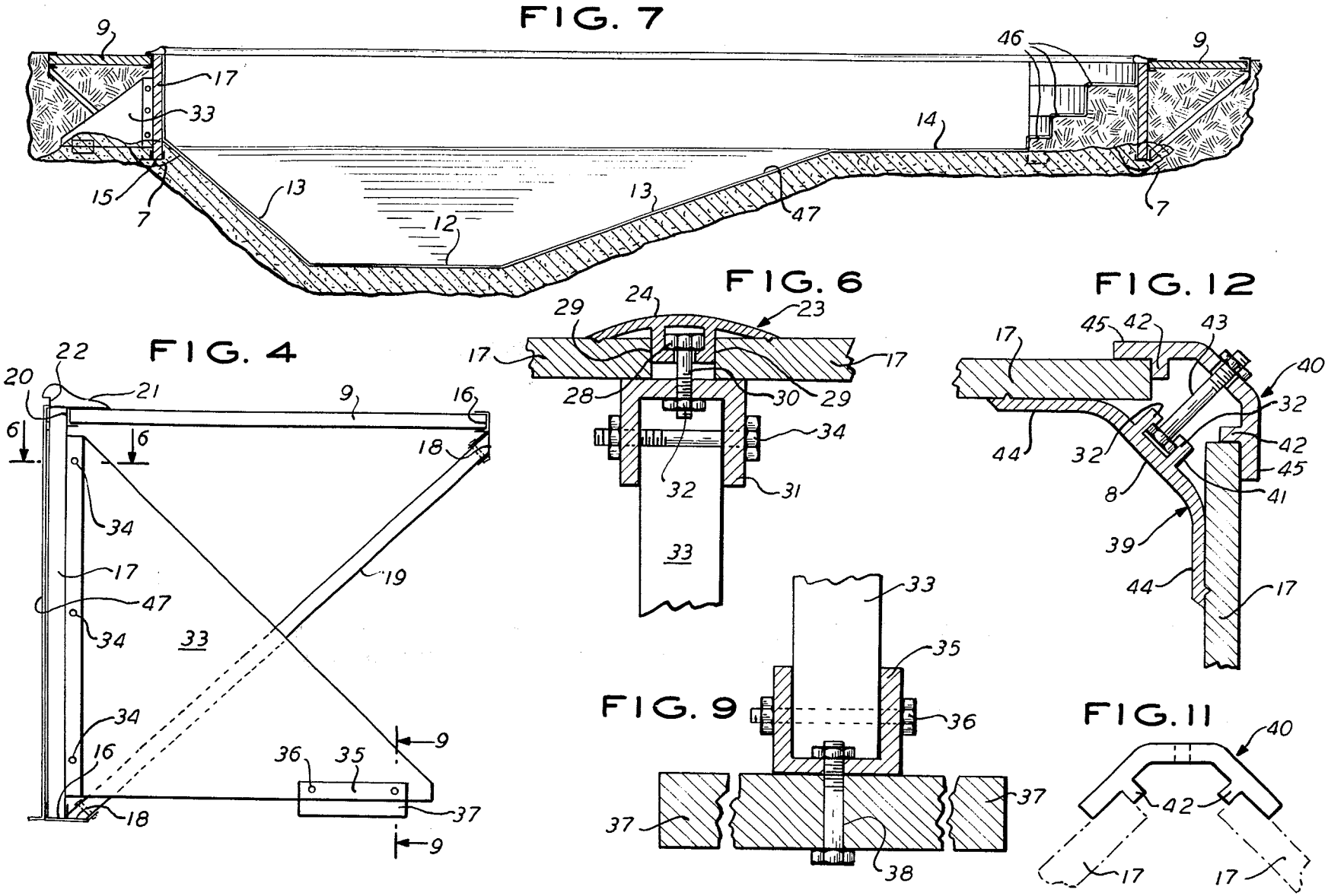
FIG. 4 is a side elevational-view of the swimming pool wall panel assembly, braces and deck.
FIG. 6 is a horizontal, sectional view of a wall joint anchored two adjacent wall panels together.
FIG. 7 is a longitudinal-sectional view of the swimming pool.
FIG. 9 is an end-sectional view of a channel that supports the generally triangular brace and a support for that channel.
FIG. 11 is an end-view of a corner back-up joint.
FIG. 12 is a top-plan view of a corner joint.

Adjacent vertical edges of the coplanar pool panels 17 are attached together by convex inner wall joints 23. The inner wall joints 23 are vertical strips having a slightly arcuate face 24 disposed inside the pools walls. On the back of the inner wall joint 23, there are longitudinal ribs 25. At the middle of the back of the inner wall joint 23, there are a pair of enlargements 26 having internal retaining lips 27, defining a bolt channel to receive a bolt-head 28. The enlargements 26 are dimensioned to intrude between pairs of adjacent vertical edges 29 of pool panels 17 as shown in FIG. 6. A bolt 30, whose head 28 is lodged in the bolt channel, is passed through a U-shaped channel 31, and a nut 32 now locks the wall joint 23 and the channel 31 together, to seize the pair of adjacent panels 17 (see FIG. 6). The bolt channel separates the adjacent panels 17,17. To maintain the panels 17 in a rigidly vertical position, a triangular brace 33 is attached along its vertical edge in the back-up channel 31, by bolts 34. The lower outer edge of the brace 33 is attached to a short U-shaped channel section 35 by bolts 36. The short section 35 rests on a support 37, to which it is similarly attached by a bolt 38. The support 37 may be of the same material as the panels 17.

Corners, where panels intersect at an angle, perhaps 90°, (or otherwise depending on the shape of the pool) are joined together similarly to panels 17 of the pool, by the complementary corner joint 39 (analagous to wall joint 23) and the corner back-up joint 40 (analagous to back-up channel 31). The corner joint 39 has a middle flat area 8 on the back of which it has a rear bolt channel 41 with retaining lips 32, to hold a bolt head. The corner back-up joint 40, has a pair of flanges 42 that define seats for abutting panels 17 intersection at the corner. That joint 40 and the joint 39 are held together by a bolt 43, thus seizing the panels 17 at each corner of the pool (see FIG. 12). The corner joint 39 has arms 44 disposed to each other at an angle slightly greater than 90° so that when the bolt 43 is tightened, the bolt channel 41 will draw the arms 44 lightly back against the panels at the 90° corner of the pool. The back-up joint 40 has arms 45 disposed at 90° to each other, so that the outer ends of the arms 45 will engage a pair of panels along their outer surfaces and the inner edges of the panels 17 will be seated on the flanges 42.

At the shallow floor 14 of the pool, the end panels 17 have a gap wherein concrete steps 46, or prefabricated plastic steps may be inserted. The steps 46 may be attached to the end panels 17 by a corner joint 39 and a corner back-up joint 40.

The joints are covered with an adherent tape (not shown) to insure a smooth, non-abrasive surface for a linear 47. Before filling the pool, concrete footings are poured around the edges of the panels 17 to cover the double channels 16, and the lower ends of the braces 19, as well as the supports 37, and channel 35 attached thereto. This provides a firm footing, joining the pool walls to the concrete base. The usual skimmers and drains are installed and connected to a pump and filter. Back-fill is supplied to bring the ground level up to the level of the deck members 9.

While any panels 17 may be used to form the pool walls, and the pool deck 9, it is preferred that three-ply laminated panels be used, made of Fiberglas front and back sheets laminated together with a center sheet of polystyrene. Such a sheet is resistant to corrosion, and may be made to an appropriate thickness as to have great strength. The triangular brace 33 and deck 19 may be made of the same material.

The corner joint 39, back-up joint 40, convex wall joint 23, channels 35 and braces 19, may be made of a strong relatively rigid, dense slightly flexible, plastic material such as polyvinyl chloride, as well as aluminum extrusions, or other metal.

Although the invention has been described in the context of an in-ground swimming pool, with a liner, it is equally suitable for use without a liner, but this requires the use of gaskets of cork, plastic or other material seized between the corner joints 3a, the convex wall joints 23, and the panels 17 in order to prevent leaks of the pool water at the joints. Also, the bottom of the panels will be carefully sealed in the cememt hopper 11 so that no pool water will escape from the bottom of the panels 17.

What is claimed is:

1. A swimming pool construction comprising:

a. vertically disposed coplanar panels having a front and a back defining the wall of a swimming pool, b. vertical edges of the panels in abutment with each other, c. a first channel at the back of a pair of the panels at their vertical abutting edges, d. a convex wall-joint attached to the first channel and covering the front of the pair of panels, at their vertical abutting edges, the wall-joint being convex with relation to the front of the pair of panels, e. means to attach together the first channel and the convex wall-joint to seize the pair of panels together, at their vertical edges, f. a generally triangular brace, having two side edges, g. one side edge of the triangular brace seated in and attached to the first channel, h. a second channel horizontally attached to at least a portion of the other side edge of the triangular brace, i. a support under the second channel, j. a third channel attached at the top of the panels, k. a deck member having an inner edge and an outer edge attached at its inner edge in the third channel, l. double-channel members, having a regular channel and an adjacent offset channel, m. regular channels of the double channel member attached to the bottom edges of the panels, n. regular channels of a double channel attached to an outer edge of a deck member, o. panels disposed vertically at an angle to each other defining a corner of a wall of a swimming pool, p. a corner-joint disposed vertically inside the corner of the wall, q. a bolt channel on the back of the corner-joint, r. a pair of arms on the corner joint, extending over the front portions of the panels which define a corner of the wall of the swimming pool, s. a corner back-up joint disposed vertically outside the corner of the wall of the swimming pool, t. a pair of flanges on the back of the corner back-up joint, u. the panels defining a pool wall corner having their vertical edges seated on the flanges, v. means to attach the corner-joint and the corner back-up joint together and to seize the panels, defining a corner.

* * * * *